US011732666B2

(12) United States Patent
Fukaya et al.

(10) Patent No.: US 11,732,666 B2
(45) Date of Patent: Aug. 22, 2023

(54) INJECTION CONTROL DEVICE

(71) Applicant: DENSO CORPORATION, Kariya (JP)

(72) Inventors: Ryo Fukaya, Kariya (JP); Yohei Suganuma, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/386,769

(22) Filed: Jul. 28, 2021

(65) Prior Publication Data

US 2022/0034277 A1 Feb. 3, 2022

(30) Foreign Application Priority Data

Jul. 29, 2020 (JP) ..... 2020-128237

(51) Int. Cl.
*F02D 41/20* (2006.01)
*F02D 41/40* (2006.01)

(52) U.S. Cl.
CPC ..... *F02D 41/20* (2013.01); *F02D 41/401* (2013.01)

(58) Field of Classification Search
CPC ..... F02D 41/20; F02D 41/26; F02D 41/40; F02D 41/401; F02D 2041/2048
USPC ..... 701/102–105; 123/198 D, 198 DB, 123/470–481, 490–497
See application file for complete search history.

(56) References Cited

U.S. PATENT DOCUMENTS 8,887,560 B2 * 11/2014 Beer ..... F02D 41/247 73/114.49
2001/0050881 A1 * 12/2001 Depaoli ..... B01F 33/05 204/554
2014/0163912 A1 * 6/2014 Gao ..... G01R 31/34 702/65
2015/0144109 A1 * 5/2015 Mukaihara ..... F02D 41/36 123/490
2016/0177855 A1 * 6/2016 Kusakabe ..... F02M 51/0685 123/490
2016/0252037 A1 * 9/2016 Katsurahara ..... F02D 41/2467 123/480
2017/0002765 A1 * 1/2017 Nakano ..... F02D 41/2467
2018/0258877 A1 * 9/2018 Satake ..... F02M 51/04
2019/0136789 A1 * 5/2019 Satake ..... F02D 41/247
2019/0203687 A1 7/2019 Yanoto
2021/0123393 A1 * 4/2021 Itaba ..... F02M 51/06

* cited by examiner

*Primary Examiner* — Hai H Huynh
*Assistant Examiner* — Johnny H Hoang
(74) *Attorney, Agent, or Firm* — Posz Law Group, PLC

(57) ABSTRACT

An injection control device includes a control IC that obtains, as sample data, a time change of a voltage generated when a fuel injection valve is driven, and determines a valve closing timing at which injection of fuel from the fuel injection valve is stopped by calculating a degree of variation from the sample data of the voltage. Further, the control IC changes the calculation of the degree of variation when a predetermined condition is satisfied.

18 Claims, 8 Drawing Sheets

INJECTION CONTROL DEVICE

CROSS REFERENCE TO RELATED APPLICATION

The present application is based on and claims the benefit of priority of Japanese Patent Application No. 2020-128237, filed on Jul. 29, 2020, the disclosure of which is incorporated herein by reference.

TECHNICAL FIELD

The present disclosure generally relates to an injection control device that controls the opening and closing of a fuel injection valve.

BACKGROUND INFORMATION

The injection control device injects fuel into the internal combustion engine by opening and closing the fuel injection valve. Conventionally, a general fuel injection valve opens and closes an injection hole by lifting and seating a valve body on an injection valve body having an injection hole. The fuel injection valve has a built-in solenoid coil and controls the position of the valve body by electrically driving the solenoid coil.

When the injection control device starts or stops energizing the solenoid coil, the valve body operates after the energization start time or energization stop time. Therefore, in order to adjust the injection amount with high accuracy, it is required to adjust the energization time in consideration of these delay times. Since the delay time changes due to the influence of (i) variation regarding the fuel injection valve usage environment, aging deterioration and characteristics of each component, and (ii) PVT (Process-Voltage-Temperature) variation of parameters of component such as the drive circuit that drives the fuel injection valve, the valve body opening timing and closing time may change based on the various environmental changes described above.

SUMMARY

It is an object of the present disclosure to provide an injection control device capable of changing the detection accuracy of the valve closing timing according to a situation.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
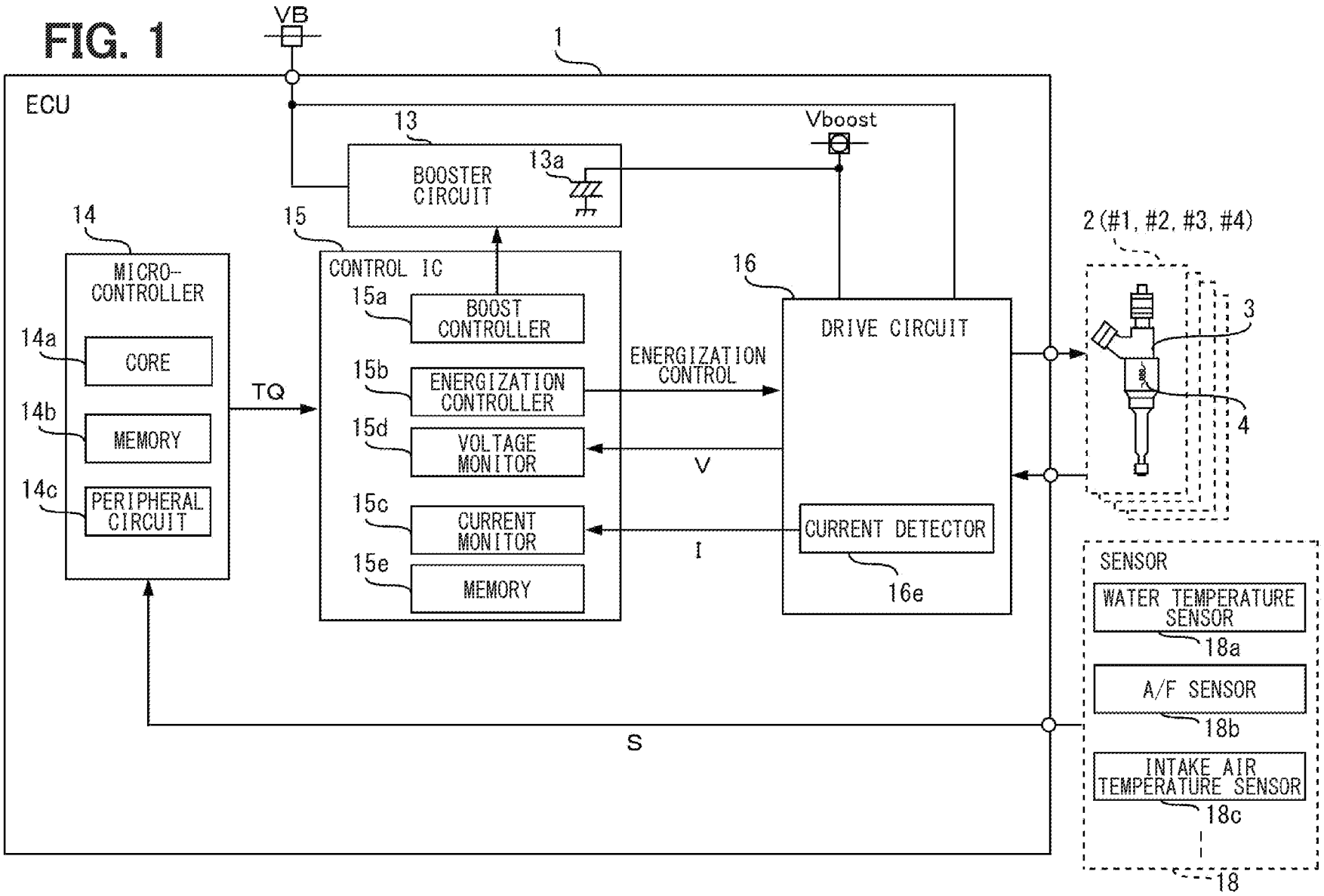
FIG. 1 is an electrical configuration diagram of an injection control device according to an embodiment.
Figure 2:
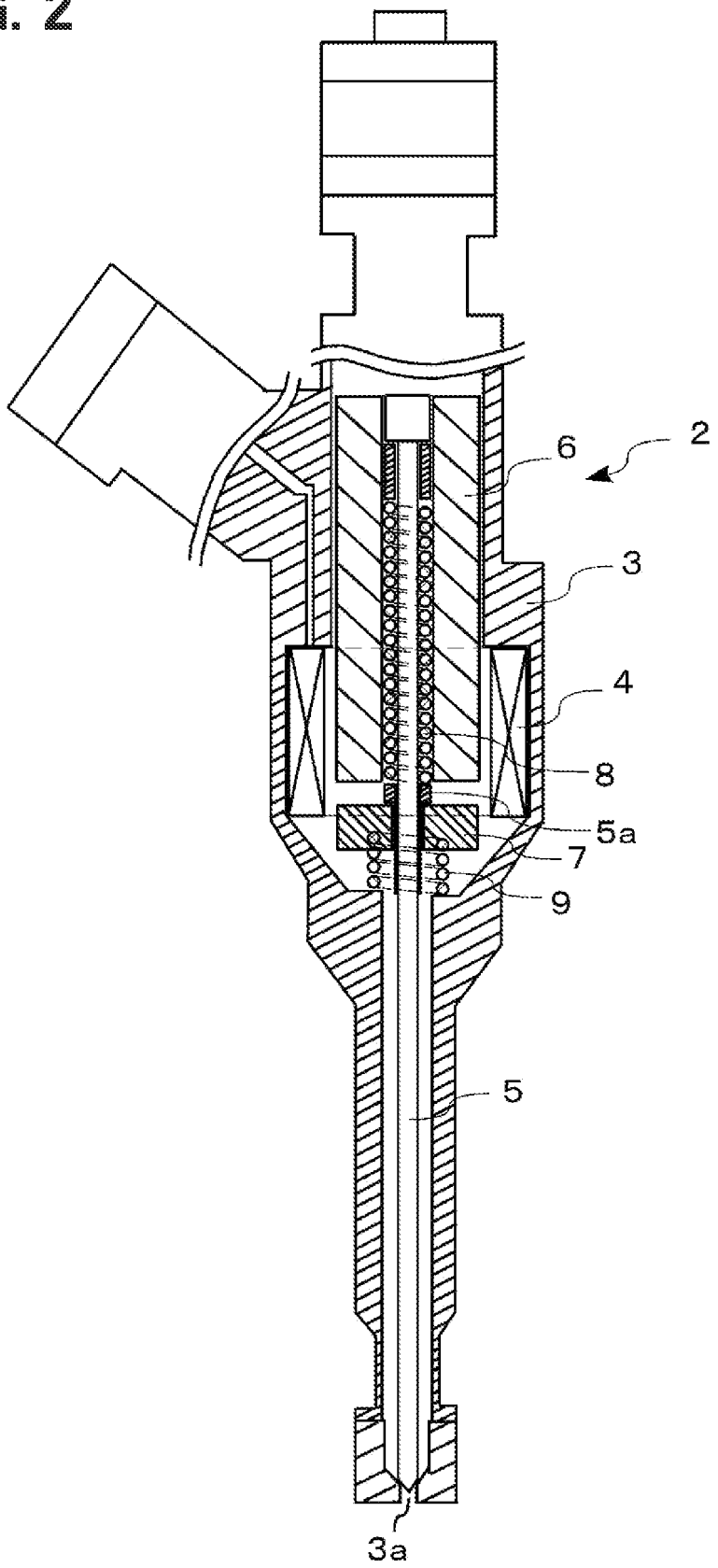
FIG. 2 is a cross-sectional view schematically showing an internal structure of a fuel injection valve.

Hereinafter, the embodiments of the present disclosure are described with reference to the attached drawings. As shown in FIG. 1, the electronic control unit 1 (ECU) drives a solenoid-type fuel injection valve 2 that directly injects and supplies fuel to an internal combustion engine mounted on a vehicle such as an automobile. The fuel injection valve 2 is also called an injector. Hereinafter, an example applied to the electronic control unit 1 for controlling a gasoline engine is described, but it may also be applied to an electronic control unit for controlling a diesel engine. Although FIG. 1 shows the fuel injection valve 2 for four cylinders, it can also be applied to three cylinders, six cylinders, and eight cylinders. As shown in FIG. 2, the fuel injection valve 2 includes a solenoid coil 4, a valve body 5, a fixed core 6, and a movable core 7 in a body 3. The valve body 5 has a cylindrical shape as a whole and has a conical shape on its tip, and is housed inside the body 3 to be movable in the axial direction. The body 3 is provided with an injection hole 3*a* on a tip end side of the valve body 5.

The fixed core 6 is fixed to the body 3. The fixed core 6 is formed of a magnetic material in a cylindrical shape, and a fuel passage is formed inside the cylinder of the fixed core 6. The movable core 7 is provided inside the body 3 and around the valve body 5. The movable core 7 is formed in a disk shape using a magnetic material made of metal, and is provided on an injection hole 3*a* side of the fixed core 6.

The movable core 7 is located inside the solenoid coil 4 and is arranged to be movable in the axial direction. When the solenoid coil 4 is not energized, it is arranged to face the fixed core 6 to have a predetermined gap between the solenoid coil 4 and the fixed core 6. A through hole is formed inside the movable core 7, and the valve body 5 is inserted and arranged in the through hole, and the movable core 7 is in contact with a locking portion 5*a* of the valve body 5. The locking portion 5*a* is fixed to the valve body 5 and is formed at a position between the movable core 7 and the fixed core 6. When the movable core 7 operates toward the fixed core 6, the valve body 5 is moved via the locking portion 5*a*.

A first spring 8 is wound inside the fixed core 6 and around the valve body 5. The first spring 8 is arranged to apply an elastic force to the valve body 5 for biasing toward the injection hole 3*a*. Further, a second spring 9 is located on an injection hole 3*a* side of the movable core 7 and is fixed to the body 3, and holds the movable core 7 in an initial position when the solenoid coil 4 is not energized.

When the solenoid coil 4 is energized, the movable core 7 is attracted toward the fixed core 6 against the elastic force of the second spring 9. When the movable core 7 operates, the valve body 5 operates in the axial direction via the locking portion 5*a*. Then, the movable core 7 comes into contact with, or abuts to, the fixed core 6. Even when the movable core 7 is in contact with the fixed core 6, the locking portion 5*a* of the valve body 5 is separated from the movable core 7 and operates in the axial direction so that the valve body 5 can still move with respect to the movable core 7. In the fuel injection valve 2, when the valve body 5 operates, the tip end of the valve body 5 is lifted and opens the injection hole 3*a* of the body 3 to inject fuel into a combustion chamber of the internal combustion engine.

When the energization of the solenoid coil 4 is stopped, the movable core 7 is returned to the initial position by the elastic force of the first spring 8 and the second spring 9. Therefore, the tip end of the valve body 5 closes the injection hole 3*a* of the body 3 to stop the fuel injection, and the fuel injection valve 2 is closed.

Next, the electrical configuration of the electronic control unit 1 is described. As illustrated in FIG. 1, the electronic control unit 1 includes an electrical configuration as a booster circuit 13, a microcontroller 14, a control IC 15, and a drive circuit 16. The microcontroller 14 is configured to include one or a plurality of cores 14*a*, a memory 14*b* such as a ROM and a RAM, and a peripheral circuit 14*c* such as an A/D converter, and is an application program stored in the memory 14*b* and various sensors 18. Various controls are performed in parallel based on a sensor signal S obtained from the above, and the fuel injection valve 2 is current-driven to control the injection of fuel into the combustion chamber of the internal combustion engine.

For example, the sensor 18 for a gasoline engine includes a crank angle sensor that outputs a pulse signal each time a crank shaft rotates by a predetermined angle, a fuel pressure sensor that detects fuel pressure at the time of fuel injection, and a throttle opening sensor that detects throttle opening, an intake amount sensor that detects the intake amount of air, a water temperature sensor 18*a* that detects cooling water temperature, an A/F sensor 18*b* that detects an air-fuel ratio of the exhaust of the internal combustion engine, that is, an A/F value, and an intake air temperature sensor 18*c* that detects the intake air temperature, and so on. FIG. 1 schematically shows the sensor (or sensors) 18.

The microcontroller 14 calculates a rotation speed (i.e., the number of rotation) of the internal combustion engine from the pulse signal of the crank angle sensor, and obtains a throttle opening degree from the throttle opening degree signal. The microcontroller 14 calculates a target torque required for the internal combustion engine based on the throttle opening degree, an oil pressure, and the A/F value, and calculates a target of a required injection amount based on the target torque.

Further, the microcontroller 14 calculates an energization command time Ti based on such a required injection amount serving as a target and the fuel pressure detected by the fuel pressure sensor, and generates an injection command signal TQ. The microcontroller 14 calculates an injection start instruction time for each of cylinders #1 to #4 based on the sensor signal S input from the various sensors 18 described above, and outputs the injection command signal TQ to the control IC 15 at such injection start instruction time.

The control IC 15 is, for example, an integrated circuit device using an ASIC, and although not shown, the control IC 15 includes, for example, a control subject such as a logic circuit and a CPU, as well as a memory 15*e* such as a RAM, a ROM, and an EEPROM, together with a comparator, and it is configured to perform various controls based on hardware and software. The control IC 15 has functions as a boost controller 15*a*, an energization controller 15*b*, a current monitor 15*c*, and a voltage monitor 15*d*.

Figure 3:
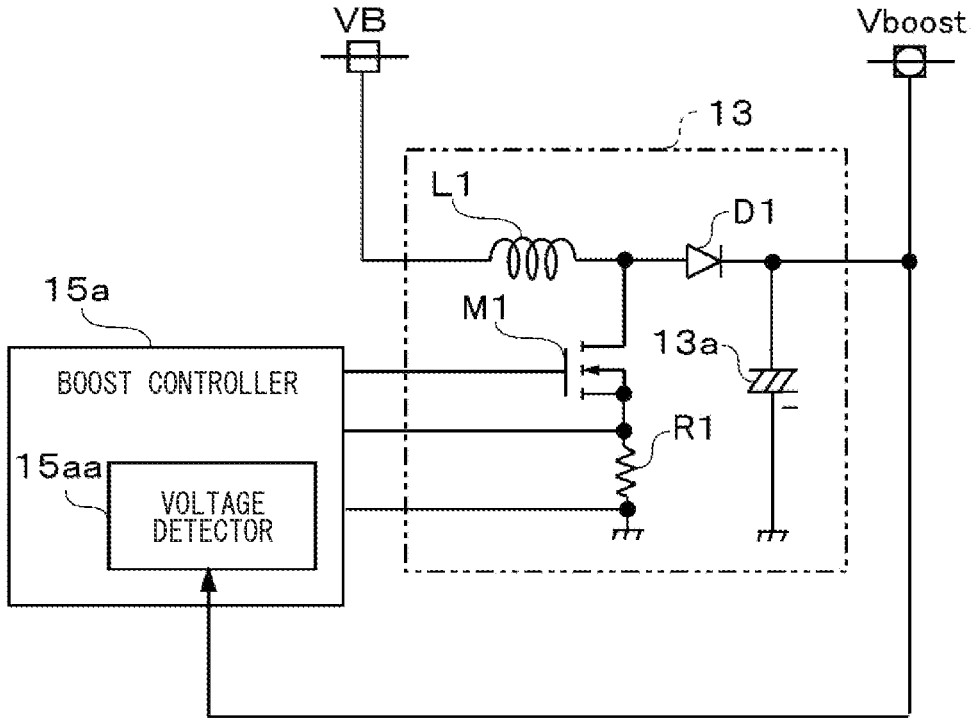
FIG. 3 is an electrical configuration diagram of a booster circuit.

As illustrated in FIG. 3, the booster circuit 13 is composed of a booster-type DCDC converter in which an inductor L1, a switching element M1, a diode D1, a current detection resistor R1, and a charging capacitor 13*a* are connected in the illustrated form. The booster circuit 13 inputs a battery voltage VB to perform a boost operation, and charges the charging capacitor 13*a* as a charging unit with a boost voltage Vboost.

The boost controller 15*a* performs a boost control of the battery voltage VB input to the boost circuit 13 by applying a boost control pulse to the switching element M1. The boost controller 15*a* detects the boost voltage Vboost of the charging capacitor 13*a* of the boost circuit 13 by a voltage detector 15*aa*, charges it to a full charge voltage, and supplies it to the drive circuit 16.

The drive circuit 16 operates by receiving an input of the battery voltage VB and the boost voltage Vboost. The drive circuit 16 directly injects fuel from the fuel injection valve 2 into each of the cylinders #1 to #4 by applying a voltage to the solenoid coil 4 based on an energization control of the energization controller 15*b* of the control IC 15.

Figure 4:
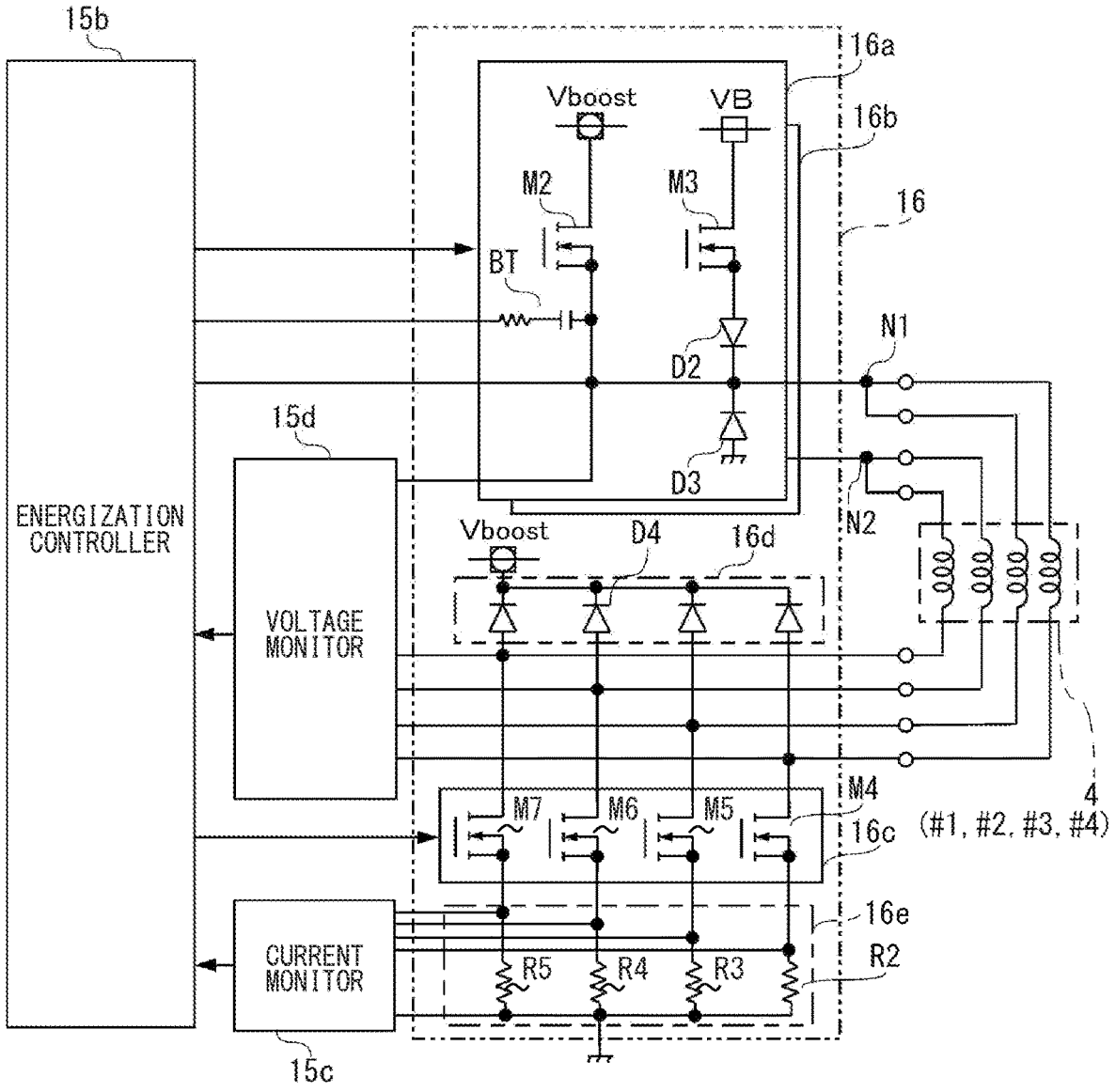
FIG. 4 is an electrical configuration diagram of a drive circuit.

In FIG. 4, the drive circuit 16 includes upstream circuits 16*a* and 16*b* connected upstream of the solenoid coil 4, downstream circuits 16*c* connected downstream of the solenoid coil 4, and a current detector circuit 16*e* (including downstream resistors R2, R3, R4, and R5).

The upstream of the solenoid coil 4 for two cylinders is commonly connected to a node N1, and the upstream of the solenoid coil 4 for the other two cylinders is commonly connected to a node N2. The upstream circuits 16*a* and 16*b* are connected to the nodes N1 and N2 to be energized, respectively, and are connected so that separate voltages can be applied to the fuel injection valves 2 for two separate cylinders (such as #1 and #4), respectively. The upstream circuits 16*a* and 16*b* have the same configuration as each other. Here, the configuration of the upstream circuit 16*a* is described, and the configuration description of the upstream circuit 16*b* is omitted. In this configuration, for example, if a voltage is applied to node N1, then either the third solenoid coil 4 or the fourth solenoid coil 4 may be respectively powered by turning ON the third or the fourth of the downstream MOSFETs M4 to allow the current to flow through the selected coil. For example, node N1 may power the fourth solenoid coil (in combination with turning ON the fourth MOSFET M4), and simultaneously N2 may power the first solenoid coil (in combination with turning ON the first downstream MOSFET M4). Other combinations of switches are possible for individually controlling individual coils 4.

The drain-source position of MOSFET M2 is connected to a position between a supply node of the boost voltage Vboost and the node N1. A boost circuit BT is connected to the source of MOSFET M2, and the boost circuit BT can improve a supply capacity of the boost voltage Vboost. Between a supply node of the battery voltage VB and the node N1, the drain-source position of MOSFET M3 and the anode-cathode position of the diode D2 are connected. The diode D2 is provided to prevent "backflow" of current towards the supply node of the battery voltage VB (for example, current from the booster circuit 13).

As a result, when the energization controller 15*b* turns ON the MOSFET M2, the boost voltage Vboost can be applied to the solenoid coil 4 of the fuel injection valve 2 for two cylinders through the node N1. Further, when the energization controller 15*b* turns ON the MOSFET M3, the battery voltage VB can be applied to the solenoid coil 4 of the fuel injection valve 2 for two cylinders through the node N1. A reflux diode D3 is connected to a position between the ground and the node N1.

On the other hand, a downstream circuit 16*c* is implemented by cylinder selection switches (downstream MOSFETs) M7, M6, M5, and M4 for respectively selecting cylinders #1 to #4 for fuel injection. The energization controller 15*b* can energize the desired solenoid coil 4 by turning ON one or two of the downstream MOSFETs at a desired timing. A regenerative circuit 16*d* is configured at a position between the downstream side of the solenoid coil 4 and the supply node of the boost voltage Vboost. The regenerative circuit 16*d* is composed of a diode D4, and when the MOSFETs M2 to M7 are turned OFF, the surplus electric power accumulated in the solenoid coil 4 can be regenerated into the charging capacitor 13*a* (drawing current from the ground through reflux diode D3).

The current detector circuit 16*e* includes current detection resistors R2, R3, aR4, and R4, also known as downstream resistors. The current detection resistor R2 detects an electric current flowing from the solenoid coil 4 through the downstream circuit 6*c*, and is configured by being connected in series to the MOSFET M4. Although not shown, the current monitor 15*c* of the control IC 15 is configured by using, for example, a comparator, an A/D converter and the like, and monitors the electric current flowing through the solenoid coil 4 of the fuel injection valve 2 by using the current detector 16*e*.

The voltage monitor 15*d* of the control IC 15 is configured by using an A/D converter (analog-digital converter, or ADC, not shown), samples a terminal voltage on the downstream of the solenoid coil 4, and stores the sample data in the memory 15*e*. The terminal voltage on the upstream of the solenoid coil 4 (at nodes N1 or N2) may also be sampled and stored in the memory 15*e*.

When the energization controller 15*b* performs a partial lift injection from the fuel injection valve 2, the energization controller 15*b* turns ON, for example, the MOSFET M4, and turns ON the MOSFET M2 to apply the boost voltage Vboost (through node N1) to the solenoid coil 4 of the fuel injection valve 2, and turns OFF the MOSFET M4 (a downstream switch) before the valve body 5 is completely lifted. The upstream MOSFET M2 may optionally also be turned OFF when the downstream MOSFET M4 is turned OFF, if the coil 4 for the third cylinder is not being used.

When full lift injection is performed from the fuel injection valve 2, the energization controller 15*b* turns ON the MOSFET_M4 of the subject cylinder, i.e., any of the cylinders #1 to #4 subject to the injection, through the drive circuit 16, and turns ON the MOSFET_M2 to apply the boost voltage Vboost to the solenoid coil 4, and thereafter the battery voltage VB is applied by turning ON/OFF the MOSFET_M3 (also known as a constant current switch) after turning OFF the MOSFET_M2 (also known as a discharge switch, because it discharges the charging capacitor 13*a* of the booster circuit 13) to perform a constant current control, and when the energization command time Ti elapses, the energization is stopped by turning OFF the MOSFETs M3 and M4. In such manner, at the time of full lift injection, the process of closing the valve body 5 is executed after the valve body 5 is completely lifted.

When the drive circuit 16 interrupts the energization current after energizing the solenoid coil 4 based on the energization control of the energization controller 15*b* of the control IC 15, a flyback voltage is generated in the solenoid coil 4. Further, when the energization current of the solenoid coil 4 is interrupted, the valve body 5 and the movable core 7 are displaced in the valve closing direction, thereby an induced electromotive force based on the displacement of the valve body 5 and the movable core 7 is generated in the solenoid coil 4. Therefore, the flyback voltage and the induced electromotive voltage are both applied to (or generated by) the solenoid coil 4. The voltage monitor 15*d* stores the sampling result of the voltage generated in the solenoid coil 4 in the memory 15*e*.

Figure 5:
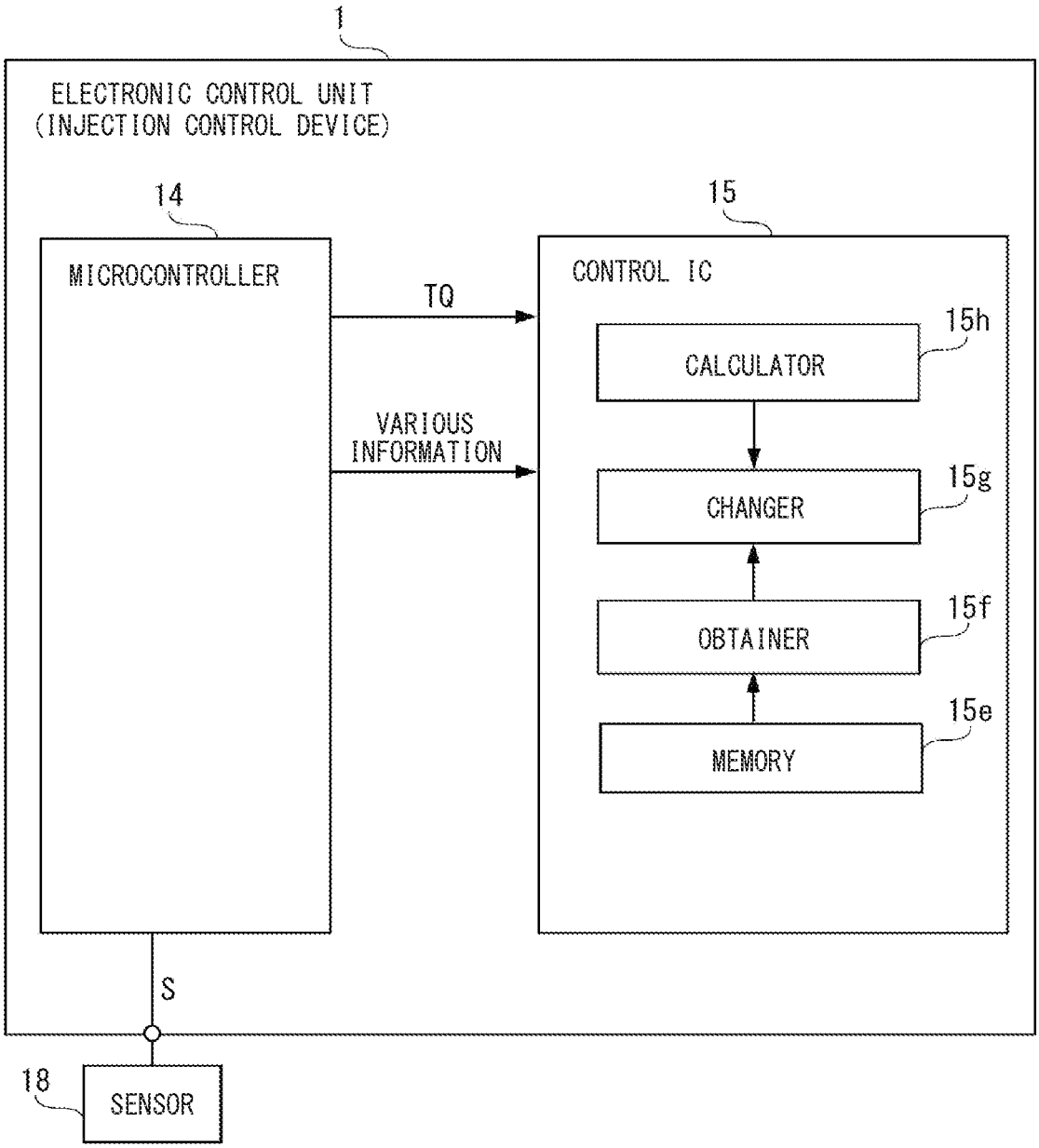
FIG. 5 is a functional configuration diagram of a microcontroller and a control IC.

The control IC 15 has a function of estimating the valve opening timing and the valve closing timing of the injection hole 3*a* based on the operation of the valve body 5. Further, as shown in FIG. 5, the control IC 15 has functions as an obtainer 15*f*, a changer 15*g*, and a calculator 15*h*. The obtainer 15*f* exhibits a function of obtaining sample data used for the valve closing timing calculation process from among the sample data of voltage stored in the memory 15*e*, i.e., from among the voltages generated when the fuel injection valve 2 is driven. The calculator 15*h* is a function of obtaining a valve closing timing t2 for stopping fuel injection from the fuel injection valve 2 by calculating a variance value from the sample data of the voltage obtained by the obtainer 15*f*.

The changer 15*g* shows a function of changing the calculation of the variance value calculated from the sample data when a predetermined condition is satisfied. More specifically, the control IC 15 changes the calculation of the variance value by the changer 15*g* according to various information received from the microcontroller 14.

The operation involving the feature according to the present embodiment is described in the following. Normally, the microcontroller 14 executes tasks related to various application programs in parallel, (i) calculating the arithmetic processing load of the microcontroller 14, and/or (ii) determining/adjusting (a) parameters related to the state of the internal combustion engine, and (b) the drive parameters for driving the fuel injection valve 2 based on the sensor signal S of the sensor 18. For example, based on the sensor signal S of various sensors 18, the microcontroller 14 determines the warm-up state of the internal combustion engine, and/or determines whether or not the rotation speed of the internal combustion engine is higher than a predetermined value.

The microcontroller 14 transmits various kinds of information to the control IC 15 together with the injection command signal TQ for single-shot injection or multi-stage injection. Note that the information transmitted by the microcontroller 14 to the control IC 15 together with the injection command signal TQ may be the sensor signal(s) S of the sensor(s) 18 itself, the determination result determined based on the sensor signal(s) S of the sensor(s) 18, or a signal representing other state(s).

Figure 6:
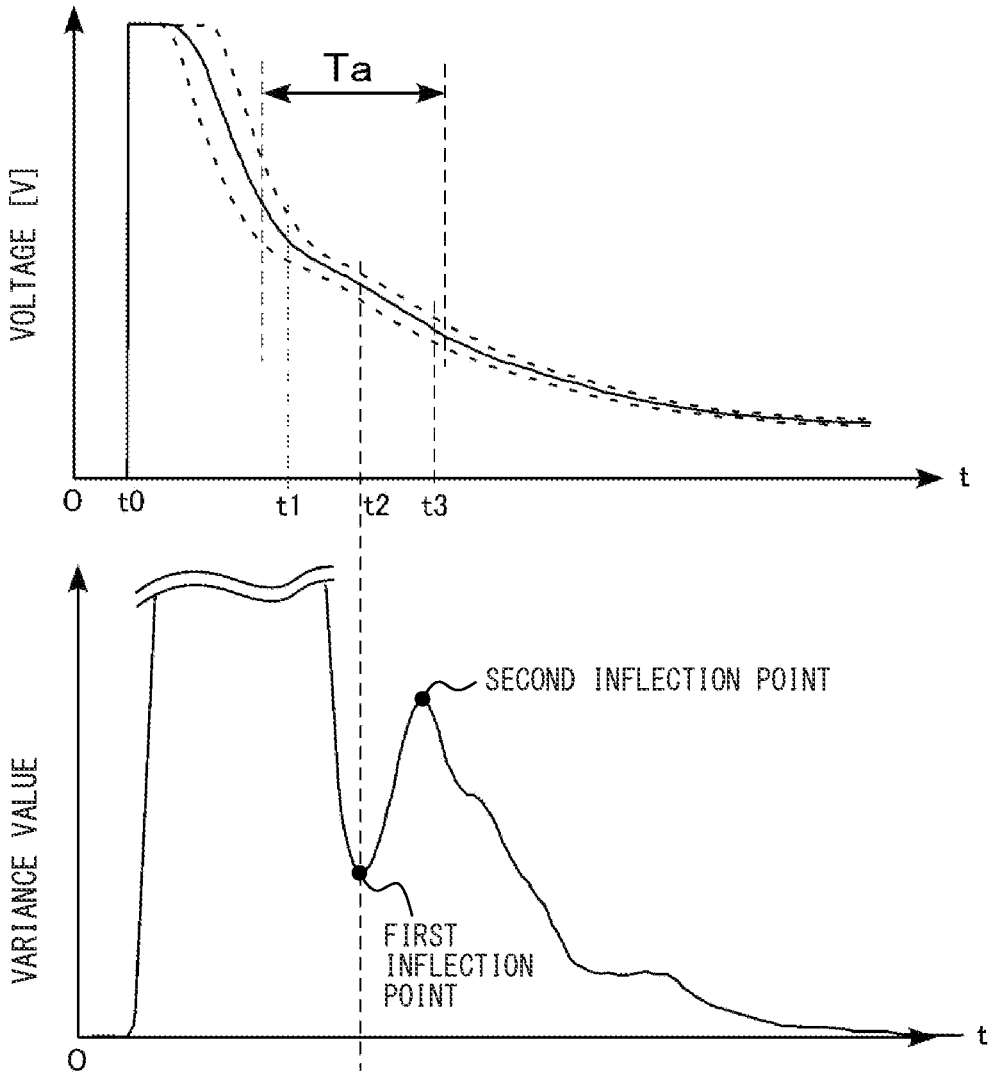
FIG. 6 is a diagram schematically showing a voltage change that occurs in a solenoid coil after turning off of energization.

FIG. 6 shows change of the terminal voltage downstream of the solenoid coil 4 detected by the voltage monitor 15*d* in response to turning OFF of the MOSFETs_M2 to M4 after the lapse of the energization command time Ti from an output of the injection command signal TQ to the control IC 15 by the microcontroller 14. The voltage monitor 15*d* samples the terminal voltage on the downstream side of the solenoid coil 4 at a predetermined sampling interval during a predetermined period Ta including at least timings t1 to t2 (see description later) after energization end timing t0, and stores the voltage sample data in the memory 15*e*.

When the energization current of the solenoid coil 4 is interrupted after the energization command time Ti has elapsed, a flyback voltage is first generated in the solenoid coil 4. At such moment, the terminal voltage on the downstream side of the solenoid coil 4 rises steeply and then gradually drops to zero. The flyback voltage drops in a smooth, downward-convex curve that is determined based on the time constant derived from circuit components including the solenoid coil 4.

While the terminal voltage on the downstream side of the solenoid coil 4 gradually drops to zero, the movable core 7 together with the valve body 5 starts to move in a direction that closes the injection hole 3*a* at timing t1 when a certain delay time elapses from energization end timing t0 (to a starting of movement). The delay time is determined based on the internal structure of the fuel injection valve 2, that is, the relative positions of the fixed core 6 and the movable core 7, the weight of the movable core 7, the elastic force of the first spring 8 and the second spring 9, and the like.

When the valve body 5 and the movable core 7 start moving, an induced electromotive force is generated in the solenoid coil 4 based on the movement of the valve body 5 and the movable core 7, thereby the terminal voltage on the downstream side of the solenoid coil 4 influences (and partially counteracts) above the above-described downward-convex curve after timing t1 as shown in FIG. 6. Thus, the graph of the terminal voltage illustrates an "upward convex" curve after timing t1, until t2. At the valve closing timing t2 when the valve body 5 almost closes the injection hole 3*a*, the moving speed of the movable core 7 becomes maximum, but then the movable core 7 steeply decelerates because the valve body 5 is seated and closes the injection hole 3*a*. At such timing, the induced electromotive force generated in the solenoid coil 4 also changes steeply (quickly changes from a maximum to zero), thereby an inflection point appears in the curve of the terminal voltage. Thereafter, since the movable core 7 moves away from the locking portion 5*a* of the valve body 5 toward the injection hole 3*a* (not shown in the figures), the induced electromotive voltage continues to be generated until a timing after the valve closing timing t2, up to, for example, timing t3.

When the valve body is seated at t2, then the valve body 5, the locking portion 5*a* (locked to the valve body 5), and the first spring 8 (pushing downward against the locking portion 5*a*) all stop moving. Further downward movement of the movable core 7 (due to inertia of the movable core 7) may be opposed by the second spring 9, but continues moving and continues to generate some induced voltage for a short time after the seating at t2. Notice that influence from the first spring 8 and from momentum of the valve body 5 end when the valve body is seated (and stops moving). Thus, the seating at t2 promptly and almost instantaneously reduces the induced voltage, because effects from the force of the first spring 8 and from the inertial of the valve body 5 are terminated. As described above, the voltage monitor 15*d* holds the sample data in the memory 15*e* at a predetermined sampling interval for the predetermined period Ta including at least the timings t1 to t2. Thereby, the sample data can be utilized for an analysis process of the valve closing timing t2.

For example, the inflection point of the terminal voltage of the solenoid coil 4 can be calculated by time-differentiating the sample data. However, when such a differential method is used, the smoothing effect of the sample data becomes particularly large as the number of the sample data increases, which then decreases the Q value of the amount of change in the differential value, and thus deteriorates an S/N (signal noise ratio).

Figure 7:
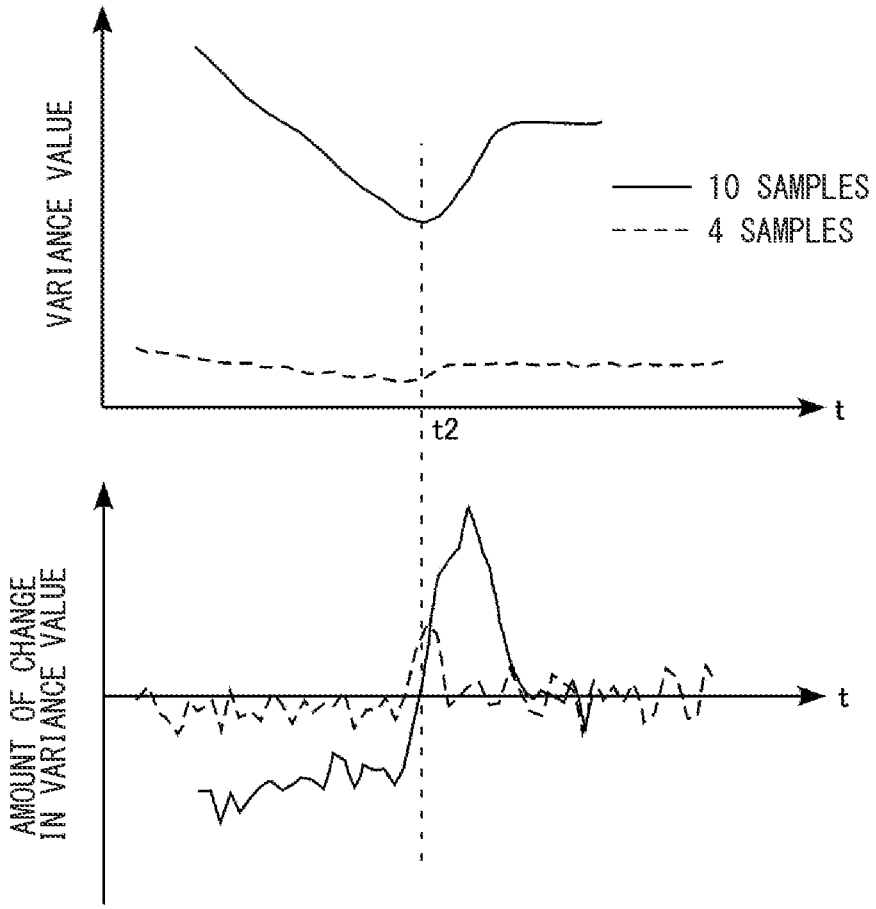
FIG. 7 is a diagram schematically showing a time change of a variance value and a derivative of the variance value.

Therefore, as shown in FIG. 7, it may be preferable to calculate the valve closing timing t2 by obtaining the inflection point of the terminal voltage by calculating the variance value indicating the degree of variation of the sample data that changes with time. That is, it may be preferable to calculate the amount of change in the variance value of the sample data, for determining a timing at which the amount of change crosses zero as the valve closing timing t2.

Specifically, we may use the concept of a ("lagging") moving average. A "five day moving average" used a value for today (such as a peak temperature of 25 degrees Celsius on Friday), and the values of the last four days (21 on Monday, 22 on Tuesday, 23 on Wednesday, and 24 on Thursday), to generate a five day moving average (21+22+23+24+25)/5=23 for today, Friday. This may be described as a "lagging" moving average, because most of the information is old. Referring briefly to equation (1) discussed below, the number N of the sample data is 5, and the variance may be associated with Friday (lagging moving average), or the variance may be associated with the entire period from Monday to Friday.

Alternatively we may use a "centered" moving average. For example, if we know the temperatures for Monday, Tuesday, Wednesday, Thursday, and Friday (same numbers as above), then the centered moving average for Wednesday (including 2 days previous, and 2 days after) is (21+22+23+24+25)/5=23. Notice that the lagging moving average previously discussed would say that Friday had a lagging moving average of 23. The lagging moving average is more common, but the centered moving average has some subtle advantages.

In the top half of FIG. 7, a moving variance value for 10 samples is shown in a solid line, and a moving variance for 4 samples is shown in a dashed line. Referring to equation 1 discussed below, the number of sample data N is either 10 or 4 in FIG. 7.

By obtaining the valve closing timing t2 by applying a variance method, as shown in FIG. 7, the amount of change in the variance value changes significantly as the number of sample data increases, thereby the zero-cross timing of the amount of change is well graspable and the S/N can be improved.

Even in the full lift injection, the amount of change in voltage caused by the change in induced electromotive force is very small. Thus, in the partial lift injection, the change in the moving speed of the movable core 7 at the time of seating becomes smaller due to the small lift amount at the start of the valve closing operation, which makes the amount of change in the induced electromotive voltage much smaller. However, even in such a case, the valve closing timing t2 can be estimable with high accuracy by increasing a number N of sample data when applying the variance method.

As described above, although the valve closing timing t2 can be detected with high accuracy while improving the S/N by using the variance method, the high-accuracy detection process of the valve closing timing t2 increases the arithmetic processing load of the control IC 15. Therefore, it may be preferable that the control IC 15 changes the calculation of the degree of variation and stops the high-accuracy detection process of the valve closing timing t2 according to various information obtained by the microcontroller 14 or the control IC 15.

For example, when the result of comparing the arithmetic processing load of the electronic control unit 1 with a predetermined first threshold value satisfies a predetermined condition, the calculation of the degree of variation may be changed. The detailed calculation change method of the degree of variation is described later. For example, when the arithmetic processing load factor by the microcontroller 14 is larger than a predetermined load factor (corresponding to the first threshold value), the control IC 15 may change the calculation of the degree of variation to reduce the arithmetic processing load. Further, when the microcontroller 14 determines that there is a process that should be prioritized over the high-accuracy detection process of the valve closing timing t2, the high-accuracy detection process of the valve closing timing t2 may be stopped.

Further, when the result of comparing the drive parameter for driving the fuel injection valve 2 with a predetermined second threshold value satisfies a predetermined condition, the control IC 15 may change the calculation of the variance value. For example, when the required injection amount calculated by the microcontroller 14 is greater than a predetermined injection amount (corresponding to the second threshold value), the control IC 15 may change the calculation of the variance value to stop the high-accuracy detection process of the valve closing timing t2.

In particular, when the required injection amount in the partial lift injection is relatively large, the influence on the target A/F value becomes small even when the injection amount deviates from the target injection amount. Therefore, when the required injection amount is large, even when the high-accuracy detection process of the valve closing timing t2 is stopped, no adverse effect will occur.

Further, when the microcontroller 14 or the control IC 15 refers to the injection command signal TQ and determines that the energization command time Ti to the fuel injection valve 2 is longer than the predetermined time (corresponding to the second threshold value), the high-accuracy detection process of the valve closing timing t2 may be stopped. This is because when the energization command time Ti is relatively long, adverse effects will not occur as described above.

Further, when applied to multi-stage injection in which other injections are continuously performed before or after the main injection, the total required injection amount of the multiple stages may be compared with the predetermined injection amount (corresponding to the second threshold value), for determining the necessity of high-accuracy detection of the valve closing timing t2. At such timing, it may be preferable to stop the high-accuracy detection process of the valve closing timing t2 on condition that the total required injection amount is greater than a predetermined injection amount.

Further, when the fuel is injected in multiple stages, the necessity of high-accuracy detection process of the valve closing timing t2 may be determined by comparing the number of injections per multi-stage injection with a predetermined number of times (corresponding to the second threshold value). In such determination, it may be preferable to stop the high-accuracy detection process of the valve closing timing t2 on condition that the number of injections per one multi-stage injection is less than a predetermined number of times. This is because it is possible to prevent the A/F value from deviating significantly from the target A/F value by avoiding the accumulation of deviations due to the increase in the number of injections of the multi-stage injection.

Further, when the result of comparing the parameters related to the state of the internal combustion engine with a predetermined third threshold value satisfies a predetermined condition, the control IC 15 may change the calculation of the degree of variation. For example, it may be preferable to stop the high-accuracy detection process of the valve closing timing t2 on condition that the cooling water temperature detected by the water temperature sensor 18*a* becomes higher than a predetermined water temperature value (corresponding to the third threshold value).

This is because the fuel is easily atomizable (formed into small droplets after injection) after the internal combustion engine has warmed up, even a bit-earlier determination of the valve closing timing t2 may increase tendency of lean shift of the A/F value, it will not cause misfire, i.e., a stable ignition is still guaranteed.

Further, the high-accuracy detection process of the valve closing timing t2 may be stopped on condition that the rotation speed of the internal combustion engine becomes higher than a predetermined rotation speed (corresponding to the third threshold value). Further, the high-accuracy detection process of the valve closing timing t2 may be stopped on condition that the intake air temperature by the intake air temperature sensor 18*c* becomes higher than a predetermined temperature (corresponding to the third threshold value). Further, the elapsed time from the time when the internal combustion engine is started may be measured by a timer, and the high-accuracy detection process of the valve closing timing t2 may be stopped on condition that the elapsed time becomes longer than a predetermined time (corresponding to the third threshold value). In the above-described situation, for the same reasons as described above, it is not necessary to detect the valve closing timing t2 with high accuracy. Hereinafter, a method of changing the calculation of the degree of variation is described. Usually, the variance value representing the degree of variation can be represented as Var[Xn] in the following equation (1).

(Equation 1)

$$\mathrm{Var}[X_n] = \frac{\sum_{n=0}^{N-1}(X_n - m)^2}{N} \tag{1}$$

In the equation (1), Xn represents a voltage sample data, N represents the number of sample data, and m represents an average value within the measurement range. The method of changing the calculation of the degree of variation may include various methods, such as (i) a method of changing a period Ts of the sample data used for the calculation of the degree of variation, (ii) a method of changing the calculation equation (1) itself used for the calculation of the degree of variation, or (iii) a method of changing the number N of sample data of the voltage used for the calculation of the degree of variation. Note, conventionally the summation index for calculating variance is shown as from n=1 to n=N, but equation 1 defines the initial value of n as 0, thus the index is from n=0 to n=(N−1), but the total number of iterations is still N.

Figure 8:
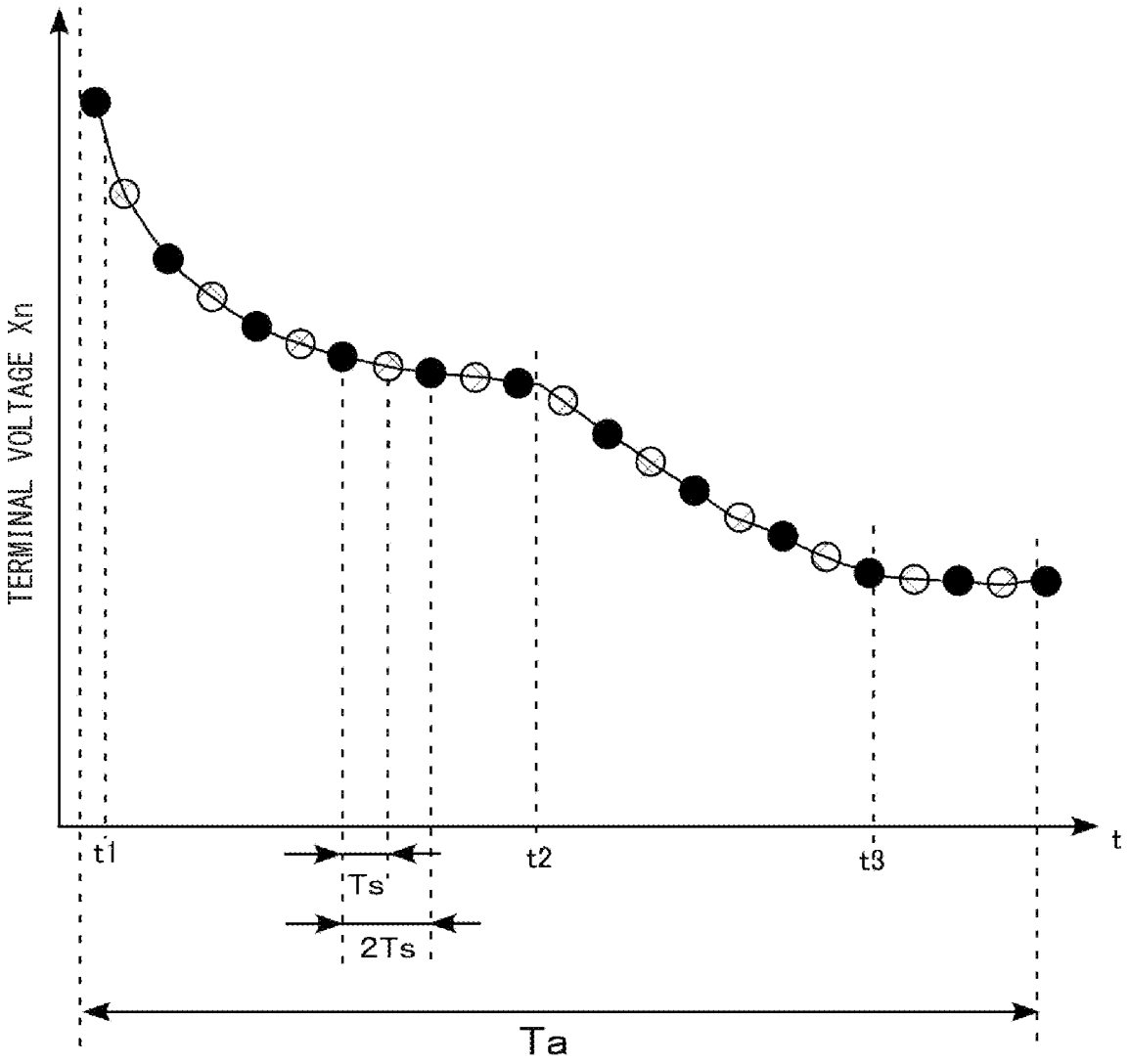
FIG. 8 is an explanatory diagram of sample data.

For example, as shown in FIG. 8, when a period of the sample data obtained by the obtainer 15*f* is Ts, the control IC 15 may set the period of the calculating the variance to 2·Ts, which is twofold of Ts, per injection, for reducing the number of calculations performed per injection. As a result, the arithmetic processing load of the degree of variation can be reduced. In this case, N may be 3, for a variance calculated based upon three samples.

Further, the control IC 15 can reduce the number of calculations by reducing the number N of sample data of the voltage for calculating the degree of variation, and can reduce the arithmetic processing load of the degree of variation.

Further, the arithmetic processing load of the degree of variation may be reduced by changing the arithmetic equation of the equation (1) to the equation (2).

(Equation 2)

$$\mathrm{Var2}[X_n] = \frac{\left(\sum_{n=0}^{N-1} |X_n - m|\right)^2}{N^2} \quad (2)$$

In the equation (2), change involves the square of the mathematical expectation, which is calculable by subtracting an average value from the sample data to obtain an absolute value and by calculating a square after summing up all the absolute values of such subtraction. As a result, the number of multiplications can be reduced and the arithmetic processing load can be reduced. By making such a change, the valve closing timing t2 can be detected while stopping the high-accuracy detection process.

As described above, according to the present embodiment, the control IC 15 obtains the time change of the voltage generated when the fuel injection valve 2 is driven as sample data, and calculates the degree of variation from the sample data of the voltage, thereby (i) obtaining the valve closing timing t2 for stopping the fuel injection from the fuel injection valve 2, and (ii) changing the calculation (e.g., method of calculation) of the degree of variation when a predetermined condition is satisfied. Thereby, the detection accuracy of the valve closing timing t2 can be changed according to the situation.

In particular, depending on the result of comparing (a) the arithmetic processing load with the predetermined first threshold value, (b) the drive parameter of the fuel injection valve 2 with the predetermined second threshold value, or (c) the parameter related to the state of the internal combustion engine with the predetermined third threshold value, the number N of sample data used for the calculation of the degree of variation, the period Ts for calculating the degree of variation, or the calculation equation of the degree of variation is changed. Thereby, the detection accuracy of the valve closing timing t2 can be changed according to the situation. Further, the arithmetic processing load can be reduced.

OTHER EMBODIMENTS

The present disclosure should not be limited to the embodiments described above, and various modifications may further be implemented without departing from the gist of the present disclosure. For example, the following modifications or extensions are possible.

Although an embodiment in which the microcontroller 14 and the control IC 15 are implemented as separate integrated circuits has been described, the microcontroller 14 and the control IC 15 may be integrally implemented as one body component. When it is integrally implemented, it may be preferable to use a high-speed processing device. In the above-described embodiment, the present disclosure is applied to in-cylinder injection that injects fuel directly into the combustion chamber of an internal combustion engine, but the present disclosure is not limited to such form, and may also be applicable to port injection that injects fuel in front of (i.e., to an upstream of) a well-known intake valve. The present embodiment is not limited to the in-cylinder injection that injects fuel directly into the combustion chamber of the internal combustion engine, as long as the fuel injection valve 2 is driven by an electric current. In the above description, in order to make the explanation easy to understand, the body 3 of the fuel injection valve 2 has been described as a one member component. However, the body 3 is not limited to such configuration.

In the above-described embodiment, the terminal voltage on the downstream side of the solenoid coil 4 is obtained in order to detect the valve closing timing t2, but the voltage node for obtaining the terminal voltage is not limited to the downstream side of the solenoid coil 4. Further, the circuit configuration of the drive circuit 16 is not limited to the configuration described above.

In the above-described embodiment, changing the calculation of the degree of variation is mainly described as stop of the high-accuracy detection process of the valve closing timing t2. However, since the high-accuracy detection of the valve closing timing t2 is required during the warm-up operation in particular, changing the calculation of the degree of variation may also be a change of the standard-accuracy detection process of the valve closing timing t2 to the high-accuracy detection process of the valve closing timing t2 in other embodiment(s).

The means and/or functions provided by a control device implemented by the microcontroller 14 and the control IC 15 can also be provided by (a) the software recorded in the actual memory device and the computer that executes the software, (b) software, (c) hardware, or (d) a combination thereof. For example, when the control device is provided by an electronic circuit which is hardware, it can be configured by a digital circuit or an analog circuit including one or a plurality of logic circuits. Further, for example, when the control device performs various controls by software, a program is stored in a storage unit, and a control subject executes the program to implement a method corresponding to the program.

In addition, the reference numerals in parentheses described in the claims simply indicate correspondence to the concrete means described in the embodiments, which is an example of the present disclosure. That is, the technical scope of the present disclosure is not necessarily limited thereto. A part of the above-described embodiment may be dispensed/dropped as long as the problem identified in the background is resolvable. In addition, various modifications from the present disclosure in the claims are considered also as an embodiment thereof as long as such modification pertains to the gist of the present disclosure.

Although the present disclosure is described based on the above embodiments, the present disclosure is not limited to the disclosure of the embodiment and the structure. The present disclosure incorporates various modifications and variations within the scope of equivalents. In addition, various modes/combinations, one or more elements added/subtracted thereto/therefrom, may also be considered as the present disclosure and understood as the technical thought thereof.

What is claimed is:

1. An injection control device for controlling injection of fuel into an internal combustion engine by driving a fuel injection valve with an electric current, the injection control device comprising:

an obtainer obtaining, as sample data, voltages generated when the fuel injection valve is driven;

a calculator calculating a valve closing timing to stop the injection of fuel from the fuel injection valve by calculating, using a first method or a second method, variances from the sample data; and a changer changing from the first method for calculating the variances to the second method for calculating the variances when a predetermined condition of the valve closing timing is satisfied, wherein one of the first method and the second method is a calculation for enabling higher accuracy detection of the valve closing timing than the other of the first method and the second method.

2. The injection control device of claim 1, wherein the first method uses a first period of obtaining the sample data, and the second method uses a second period of obtaining the sample data that is different from the first period.

3. The injection control device of claim 1, wherein the first method uses a first number of voltages as the sample data, and the second method uses a second number of voltages as the sample data that is different from the first number of voltages.

4. The injection control device of claim 1, wherein the first method uses a first equation, and the second method uses a second equation that is different from the first equation.

5. The injection control device of claim 1, wherein the predetermined condition compares an arithmetic processing load against an arithmetic threshold value.

6. The injection control device of claim 1, wherein the predetermined condition compares a drive parameter of the fuel injection valve against a drive parameter threshold value.

7. The injection control device of claim 1, wherein the predetermined condition compares a parameter related to a state of the internal combustion engine against a state threshold value.

8. The injection control device of claim 1, wherein the one of the first method and the second method is a method based on Equation 1, and the other of the first method and the second method is a method based on Equation 2.

9. The injection control device of claim 1, wherein the changer further determines whether the predetermined condition of the valve closing timing is satisfied.

10. An injection control device for controlling injection of fuel into an internal combustion engine by driving a fuel injection valve with an electric current, the injection control device comprising:

a processor; and a non-transitory computer-readable storage medium, wherein the injection control device is configured to:

obtain, as sample data, voltages generated when the fuel injection valve is driven;

calculate a valve closing timing to stop the injection of fuel from the fuel injection valve by calculating, using a first method or a second method, variances of the sample data; and change from a first method from the first method for calculating the variances to the second method for calculating the variances when a predetermined condition of the valve closing timing is satisfied, wherein one of the first method and the second method is a calculation for enabling higher accuracy detection of the valve closing timing than the other of the first method and the second method.

11. The injection control device of claim 10, wherein the injection control device is further configured to:

change a period of sampling used for calculating the variances when the predetermined condition is satisfied.

12. The injection control device of claim 10, wherein the injection control device is further configured to:

change a number of the sample data of the voltage used for calculating the variances when the predetermined condition is satisfied.

13. The injection control device of claim 10, wherein the injection control device is further configured to:

change an equation of calculation used for calculating the variances when the predetermined condition is satisfied.

14. The injection control device of claim 10, wherein the injection control device is further configured to:

change from the first method to the second method when a result of comparison between an arithmetic processing load of the injection control device with a predetermined load threshold value satisfies the predetermined condition.

15. The injection control device of claim 10, wherein the injection control device is further configured to:

change from the first method to the second method when a result of comparison between a drive parameter of the fuel injection valve with a predetermined drive threshold value satisfies the predetermined condition.

16. The injection control device of claim 10, wherein the injection control device is further configured to:

change from the first method to the second method when a result of comparison between a parameter related to a state of the internal combustion engine with a predetermined state threshold value satisfies the predetermined condition.

17. The injection control device of claim 10, wherein the one of the first method and the second method is a method based on Equation 1, and the other of the first method and the second method is a method based on Equation 2.

18. The injection control device of claim 10, wherein the injection control device is further configured to determine whether the predetermined condition of the valve closing timing is satisfied.

* * * * *